United States Patent [19]

Brigham et al.

[11] Patent Number: 4,819,454

[45] Date of Patent: Apr. 11, 1989

[54] LIQUID CRYOGENIC VAPORIZER UTILIZING AMBIENT AIR AND A NONFIRED HEAT SOURCE

[75] Inventors: William D. Brigham, Huntington Beach; Dinh Nguyen D., Orange City, both of Calif.

[73] Assignee: Zwick Energy Research Organization, Inc., Huntington Beach, Calif.

[21] Appl. No.: 146,846

[22] Filed: Jan. 22, 1988

[51] Int. Cl.[4] ..... F17C 7/02

[52] U.S. Cl. ..... 62/52; 60/618; 60/648

[58] Field of Search ..... 62/52, 53; 60/618, 648

[56] References Cited

U.S. PATENT DOCUMENTS

| | | | |
|---|---|---|---|
| 4,197,712 | 4/1980 | Zwick et al. | 62/53 |
| 4,290,271 | 9/1981 | Granger | 62/53 |
| 4,409,927 | 10/1983 | Loesch et al. | 62/53 |
| 4,420,942 | 12/1983 | Davis et al. | 62/53 |
| 4,458,633 | 7/1984 | Loesch | 62/52 |
| 4,519,213 | 5/1985 | Brigham et al. | 62/52 |

*Primary Examiner*—Ronald C. Capossela

*Attorney, Agent, or Firm*—Vernon D. Beehler; Ralf H. Siegemund; William H. Pavitt, Jr.

[57] ABSTRACT

A liquid cryogen vaporizer is devised in which the cryogenic liquid is first partially vaporized in a cryogenic heat exchanger which is provided with heat from nonfired sources. The partially vaporized liquid cryogen is then completely vaporized in a second downstream cryogenic heat exchanger also provided with heat from the nonfired sources. The nonfired sources comprise an internal combustion engine and an ambient air heat exchanger. The internal combustion engine drives a hydraulic circuit which provides a constant load on the engine. A cryogenic pump used to flow the cryogenic liquid through the cryogenic heat exchanger is in turn hydraulically driven from this circuit. Heat is also transferred from the hydraulic circuit into a heat exchanging circuit. The heat exchanging fluid is driven around the heat exchanging circuit by means of a pump driven by the engine through the ambient air heat exchanger, a hydraulic heat exchanger and the first cryogenic heat exchanger. Engine coolant is provided to the second cryogenic heat exchanger. A defrost heat exchanger is also provided with engine coolant and it periodically flushed with heat exchanging fluid to provide a predetermined quantity of heated fluid to defrost said ambient air heat exchanger.

20 Claims, 1 Drawing Sheet

LIQUID CRYOGENIC VAPORIZER UTILIZING AMBIENT AIR AND A NONFIRED HEAT SOURCE

BACKGROUND OF THE INVENTION

1. Field of the Invention

The invention relates to the field of liquid cryogenic vaporizing equipment and in particular to cryogenic vaporizers utilizing nonfired heat sources.

2. Description of the Prior Art

Historically liquid cryogen vaporizers utilized fired heat sources for vaporizing the cryogenic liquid. A fired heat source is a heat source which uses an open flame or at least a substantially continuous flame in a combustion chamber to create heat which is then utilized by various means to vaporize the cryogenic liquid. The gas is then used in a wide variety of applications ranging from the field of petroleum engineering through aerospace applications.

However, as off-shore petroleum drilling became a more important segment of oil industry, a need arose to insure that all equipment on the oil rig was flame or spark proof to prevent accidental ignition of leaking petroleum gases and fluids. See Zwick et.al., "Fluid Pumpling and Heating System," U.S. Pat. No. 4,197,712.

Therefore, cryogenic vaporizers were developed which drew energy from the air or sea water, or from nonfired heat sources such as internal combustion engines, see Brigham et.al., "Ambient Air Heated Electrically Assisted Cryogen Vaporizer," U.S. Pat. No. 4,519,213.

Although many of these prior art units were very successful in the applications for which they were used, they all suffered from the limitation as to capacity. For example, a pressurized hydraulic loop is included within the system in those nonfired heat sources utilizing internal combustion engines as the heat source. As the quantity of heat which must be produced by the system increases, design and engineering considerations dictate that the pressures and flow rates in the hydraulic loop also increase. However, as the size and pressure ratings of the hydraulic system increases, the cost and complexity of the component parts for such hydraulic system also make a considerable jump. As a result, the cost and engineering problems which with very large high pressure hydraulic systems in nonfired liquid cryogenic vaporizers begins to render the system impractical, or at the very least, uneconomical.

Therefore, what is needed is a design for a nonfired liquid cryogenic vaporizer which can deliver large quantities of heat to the liquid cryogen but can do so in a manner that does not invoke the special engineering problems typically related to high pressure, large flow rate hydraulic systems of the prior art or which result in the very expensive system.

BRIEF SUMMARY OF THE INVENTION

The invention is an apparatus for vaporizing a liquid cryogen comprising a heat source; a first element for extracting heat from the ambient environment; a second element for extracting heat from the ambient environment; a third element for transferring heat from one of the first and second element to the liquid cryogen to partially vaporize the liquid cryogen; and a separate fourth element for transferring heat from the heat source to the liquid cryogen to completely vaporize the partially vaporized liquid cryogen.

As a result, the liquid cryogen is completely vaporized at high flow rate in an economic manner.

In one embodiment the third element transfers heat only from the heat source into the partially vaporized liquid cryogen.

In another embodiment the third element transfers heat from both the heat source and the first element into the liquid cryogen to partially vaporize the liquid cryogen.

The apparatus further comprises a fifth element for selectively transferring heat from the heat source to the first element for extracting heat from the ambient environment to defrost the first element.

The fifth element is also for selectively removing heat from the heat source to regulate the temperature of the heat source.

The heat source is a nonfired heat source.

The nonfired heat source comprises an internal combustion engine, hydraulic pump, load element, hydraulic drive and cryogenic pump. The hydraulic pump has an output and intake. The hydraulic pump is coupled to and driven by the internal combustion engine. The load element provides a constant load on the hydraulic pump. The load element is coupled to the output of the hydraulic pump. The hydraulic drive. The hydraulic drive receives hydraulic fluid from the load element and is driven thereby. The cryogenic pump is coupled to and is driven by the hydraulic drive. The cryogenic pump pumps the liquid cryogen through the apparatus.

Alternatively the nonfired heat source comprises a liquid cryogenic pump for passing the fluid to be vaporized through the third and fourth element. A heat engine provides shaft power and heat output. Part of the shaft power is used to drive the liquid cryogenic pump. Heat from the heat source is used in the third and fourth element. A loading element increases the pumping load on the engine shaft to thereby provide sufficient heat to heat the liquid cryogenic in the third and fourth element. The amount of heat provided is directly proportional to the flow rate of the liquid cryogen provided by the cryogenic pump.

The invention is also a method for vaporizing a cryogenic liquid at high flow rates comprising the steps of extracting heat from the ambient environment. Heat is simultaneously extracted from a heat source. The heat extracted from the ambient environment and heat source is transferred into a liquid cryogen to partially vaporize the liquid cryogen. Heat is subsequently transferred into the partially vaporized liquid cryogen to completely vaporize the cryogenic liquid.

As a result, the cryogenic liquid may be vaporized at the high flow rates in a manner which is economically performed.

The step of simultaneously extracting heat from a heat source further comprises the steps of utilizing a heat engine to provide shaft power and heat, and providing a constant load on the engine so that the engine operates at a greater power level than necessary to provide the shaft power.

The method further comprises the steps of pumping the liquid cryogen through a flow path and utilizing a part of the shaft power of the engine to effect the step of pumping. In the step of providing the constant load on the engine, the engine is operated at a greater power level than necessary to effect the step of pumping in absence of the constant load in order to provide increased heat from the engine. In the step of transferring heat to partially vaporize the liquid cryogen, the heat is tranferred from the engine into the liquid cryogen flowing through the flow path. The amount of heat provided is directly proportional to the flow rate of the liquid cryogen.

The heat source is an internal combustion engine having an engine cooling circuit and the step of selectively transferring heat from the heat source to the ambient air heat exchanger comprises the steps of selectively filling a defrost heat exchanger with a heat exchanging fluid and heating the heat exchange fluid in the defrost heat exchanger to a predetermined temperature. The heat exchanging fluid is automatically flushed from the defrost heat exchanger when the temperature of the heat exchanging fluid reaches a predetermined temperature. The fluid flushed from the defrost heat exchanger is pumped through the ambient air heat exchanger to defrost the ambient air heat exchanger.

Thus, the step of extracting heat from the ambient environment comprises the step of flowing air through a heat exchanger to transfer heat from the air to a heat exchanging medium and thence to the liquid cryogen. The method also comprises in combination the step of selectively transferring heat from the heat source to the ambient air heat exchanger to defrost the heat exchanger.

The invention can also be characterized as an apparatus for vaporizing a cryogenic liquid at high flow rates comprising an internal combustion engine for producing heat and shaft power. A heat exchanging fluid pump having an input and output pumps heat exchanging fluid. The pump is driven by the engine. An ambient air heat exchanger is provided having an input coupled to the output of the heat exchanging fluid pump. A fan mechanism flows air through the ambient air heat exchanger. The air is drawn from the ambient environment to transfer heat from the ambient environment into heat exchanging fluid pumped through the ambient air heat exchanger by the heat exchanging fluid pump. A hydraulic heat exchanger is coupled to the ambient air heat exchanger for receiving the heat exchanging fluid from the ambient air heat exchanger. The hydraulic heat exchanger transfers heat into the heat exchanging fluid from hydraulic fluid being flowed through the hydraulic heat exchanger. In the preferred embodiment a first liquid cryogen heat exchanger is coupled to the hydraulic heat exchanger and receives the heat exchanging fluid from the hydraulic heat exchanger. Other placements of the heat exchangers is expressly contemplated in the invention. The liquid cryogen heat exchanger transfers heat from the heat exchanging fluid into the liquid cryogen flowing through the liquid cryogen heat exchanger. A cryogenic pump pumps the liquid cryogen through the liquid cryogen heat exchanger. The heat exchanging fluid is returned from the liquid cryogen heat exchanger to the heat exchanging fluid pump. In the preferred embodiment a small sized hydraulic subsystem is provided which is comprised of a hydraulic pump coupled to and driven by the engine. Again other means and manners of loading the engine are expressly included within the scope of the invention. The hydraulic pump has an output and intake. A load element provides a constant hydraulic load on the hydraulic pump. The load element is coupled with the hydraulic pump through the output of the hydraulic pump. A hydraulic drive is coupled with the load element for receiving hydraulic fluid from the load element. The hydraulic drive provides shaft power for driving the cryogenic pump. The hydraulic fluid flowing through the hydraulic drive is provided to and flows through the hydraulic heat exchanger for heat transfer from the hydraulic fluid to the heat exchanging fluid. The hydraulic fluid is returned from the hydraulic heat exchanger to the intake of the hydraulic pump. An engine coolant mechanism circulates engine coolant through the engine to remove heat from the engine. A second liquid cryogen heat exchanger is coupled with the first liquid cryogen heat exchanger. The second liquid cryogen heat exchanger completely vaporizes the liquid cryogen flowing thereto from the first cryogen heat exchanger. The engine coolant is also provided to the second liquid cryogen heat exchanger and then returned to the engine.

As a result, the apparatus vaporizes the liquid cryogen at high flow rates utilizing the small sized hydraulic subsystem.

The apparatus further comprises an exhaust heat exchanger. Exhaust is provided from the engine to the exhaust heat exchanger. The engine coolant is also provided to the exhaust heat exchanger so that heat is transferred from the exhaust into the engine coolant. The heated engine coolant is then provided to the second liquid cryogen heat exchanger.

The apparatus further comprises a defrost heat exchanger coupled with the second liquid cryogen heat exchanger. The defrost heat exchanger is selectively provided with the engine coolant and is selectively provided with the heat exchanging fluid. The engine coolant and heat exchanging fluid is in heat exchanging relationship within the defrost heat exchanger. A first thermostatically controlled element selectively provides the engine coolant to the defrost heat exchanger at a first predetermined temperature. A second thermostatically controlled element selectively provides the heat exchanging fluid to the defrost heat exchanger at a second predetermined temperature.

The first thermostatically controlled element selectively provides engine coolant to the defrost heat exchanger when the engine coolant rises above a predetermined temperature. The second thermostatically controlled element provides heat exchanging fluid to the defrost heat exchanger when the heat exchanging fluid temporarily stored within the defrost heat exchanger exceeds a predetermined temperature.

The invention and its various embodiments may be better visualized by turning to the following drawing.

Figure 1:
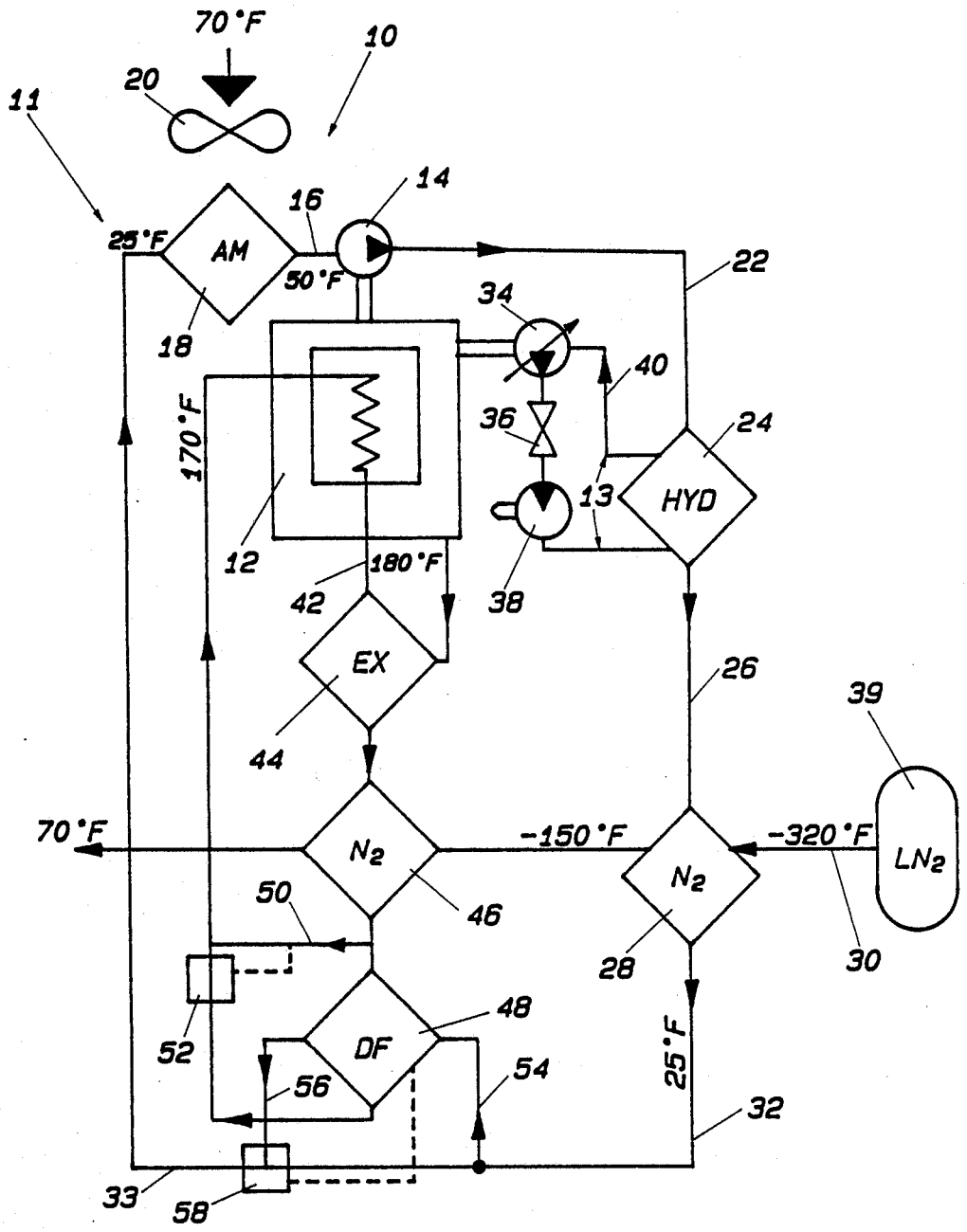
FIG. 1 is a schematic of a system embodying the invention.

The invention and its various embodiments may be better understood by now turning to the following detailed description.

DETAILED DESCRIPTION OF THE PREFERRED EMBODIMENT

A liquid cryogen vaporizer is devised in which the cryogenic liquid is first partially vaporized in a cryogenic heat exchanger which is provided with heat from nonfired sources. The partially vaporized liquid nitrogen is then completely vaporized in a second downstream cryogenic heat exchanger also provided with heat from the nonfired sources. The nonfired sources comprise an internal combustion engine and an ambient air heat exchanger. The internal combustion engine drives a hydraulic circuit which provides a constant load on the engine. A cryogenic pump used to flow the cryogenic liquid through the cryogenic heat exchanger is in turn hydraulically driven from this circuit. Heat is also transferred from the hydraulic circuit into a heat exchanging circuit. The heat exchanging fluid is driven around the heat exchanging circuit by means of a pump driven by the engine through the ambient air heat exchanger, a hydraulic heat exchanger and the first cryogenic heat exchanger. It is to be expressly understood that the hydraulic heat exchanger can be situated in a number of positions within the heat exchanging fluid loop without departing from the scope of the invention. Engine coolant is provided to the second cryogenic heat exchanger. A defrost heat exchanger is also provided with engine coolant and it periodically flushed with heat exchanging fluid to provide a predetermined quantity of heated fluid to defrost said ambient air heat exchanger.

FIG. 1 is a schematic of the hydraulic circuit and heat exchanging circuits in an apparatus devised according to the invention. It must be understood that storage tanks, fuel tanks and other systems such as vehicular or motive systems may be added as desired. Therefore, the present discussion will be confined to that portion of the system in which the heat is created and delivered to the cryogenic liquid and shall not be directed to other subsystems or components relating to the liquid cryogenic supply, liquid cryogenic delivery subsystem, any motive subsystems and the like.

FIG. 1 thus shows a system, generally denoted by reference numeral 10, which diagrammatically depicts an engine 12, which in the illustrated embodiment is an internal combustion engine. More particularly, conventional diesel engines are utilized having a horsepower sized according to the invention. Engine 12 drives a pump 14 which is used to pressurize a heat exchanging fluid in a heat exchange circuit 11, typically a circuit 11 utilizing a water-glycol mixture. The input of pump 14 is coupled via line 16 to an ambient air heat exchanger 18. Ambient air is forced through heat exchanger 18 by a circulation fan 20 or other equivalent means. The temperature of the heat exchanging medium in line 16 will be below the ambient temperature, for example in the illustrated embodiment will be delivered to ambient air heat exchanger 18 at approximately 25 degrees F.

Assuming for the purposes of example that the ambient air temperature is at 70 degrees F., the outlet temperature from heat exchanger 18 will be at approximately 50 degrees F. The output of the heat exchanger 18 is led through line 16, pump 14, and line 22 to a hydraulic heat exchanger 24. Heat is transferred through hydraulic heat exchanger 24 from a hydraulic circuit 13 which will be described below. As a result, the heat exchanging fluid exits hydraulic heat exchanger 24 at approximately 55 degrees F.

The heat exchanging fluid is then delivered via line 26 to a cryogenic heat exchanger 28. In the illustrated embodiment the liquid cryogen is liquid nitrogen which is delivered from a storage source (not shown) along an input line 30 by a cryogenic pump 39. The liquid nitrogen is at approximately −320 degrees F. at the input to nitrogen heat exchanger 28. The liquid nitrogen is partially vaporized within heat exchanger 28 exits heat exchanger 28 as a mixture of gas and liquid at approximately −150 degrees F.

Meanwhile, the heat exchanging fluid exits from the hot side of heat exchanger 28 at approximately 25 degrees F. and is returned via line 32 to heat exchanger 18, line 16 and the intake of pump 14.

Engine 12 also drives a variable displacement hydraulic pump 34. Pump 34 forces a hydraulic fluid through a constant backpressure device 36 into a hydraulic drive 38. Constant backpressure device 36 may be a constant backpressure valve, a water brake, or other hydraulic loading device. In the preferred embodiment, the output shaft of hydraulic drive 38 is coupled to and drives cryogenic pump 39 or may then be utilized elsewhere within system 10 where needed. Other arrangements for driving cryogenic pump 39 are contemplated as being within the invention. Hydraulic fluid exits hydraulic drive 38 and is fed to the intake of hydraulic heat exchanger 24. Heat built up within the hydraulic loop 13, comprising hydraulic pump 34, backpressure device 36 and hydraulic drive 38, is thus transferred to the heat exchanging fluid through hydraulic heat exchanger 24 and thence returned along line 40 to the intake of hydraulic pump 34.

The amount of heat from the engine which is provided to liquid nitrogen flowing through apparatus 10 is always proportional to the rate of flow regardless of the flow rate and delivery pressure of the nitrogen. However, some of the heat provided to the cryogen comes from the air, which is dependent on factors other than the engine. Therefore, the total heat provided to the cryogen is not always strictly proportional. Engine 12 provides shaft horsepower to pump 34. Pump 34, working against a constant backload provided by load means 36, in turn drives hydraulic drive 38 which is coupled to liquid nitrogen pump 39. Liquid nitrogen pump 39 is a positive displacement pump which pumps the liquid nitrogen through heat exchangers 28 and 46. Therefore the amount of hydraulic fluid pumped by hydraulic pump 34 is proportional to the amount of liquid nitrogen pumped by nitrogen pump 39. However, the amount of shaft horsepower provided by engine 12 to pump 34 will be divided between the nitrogen pumping energy provided through hydraulic pump 38 to nitrogen pump 39 and hence to the liquid nitrogen and to heat generated in the hydraulic fluid circulated through the hydraulic subcircuit. However, regardless of whether the energy is delivered by means of pumping the nitrogen or heating the hydraulic fluid, the energy is ultimately transferred to the liquid nitrogen either through hydraulic heat exchanger 24 and liquid nitrogen heat exchanger 28, or through pump 39. The total amount of energy, or more properly the enthalpy delivered to the liquid nitrogen is substantially constant over a wide range of pressures. Liquid nitrogen will vaporize provided that a sufficient total amount of energy is delivered to it to raise its enthalpy to the vaporization point.

Therefore, at a fixed flow rate, should the pressure at which the nitrogen is being supplied suddenly change thereby causing pump 39 and hydraulic drive 38 to work less, the same amount of energy will nevertheless still be delivered to the liquid nitrogen through the heat then transferred to the hydraulic fluid and ultimately through heat exchanger to the liquid nitrogen. The energy provided by engine 12 will always remain proportional to the flow rate of the liquid nitrogen since liquid nitrogen pump 39 is a positive displacement pump and the flow rate is changed by selective control of the variable displacement hydraulic pump 34.

Engine coolant, from engine 12, may also be provided along output line 42 to the input of an exhaust gas heat exchanger 44. Exhaust from engine 12 is provided to exchanger 44 and typically adds about an additional 10 degrees F. to the temperature of the engine coolant. For example, if the temperature of the exiting engine coolant is approximately 180 degrees F. upon entering the exchanger 44, fluid exiting exchanger 44 will be approximately 190 degrees F.

The engine coolant then is provided to a second nitrogen exchanger 46. The partially vaporized nitrogen from heat exchanger 28 is provided to the intake of heat exchanger 46 with the result that the exiting nitrogen is completely gasified and heated to approximately 70 degrees F.

The engine coolant exits heat exchanger 46 at approximately 170 degrees F. and flows through bypass line 50 to be returned to the water jacket of engine 12. It is important to regulate the cooling temperature of engine 12 within predetermined design limits in order to maintain the intended and best operation of engine 12. Therefore, normally the engine coolant will be circulated through bypass line 50 and thermostatically controlled three-way valve 52 back to the inlet of the engine coolant at approximately 170 degrees F. In the event that engine 12 begins to overheat for any reason, thermostatically controlled valve 52 opens allowing the overheated engine coolant to circulate through heat exchanger 48. Heat is transferred through heat exchanger 48 to the heat exchanging fluid in or flowing into exchanger 48 in line 32.

Defrost heat exchanger 48 is a shell and tube heat exchanger that has a predetermined or enhanced fill or storage capacity. In otherwords, heat exchanger 48 will typically have a reservoir capacity of approximately 20 to 60 gallons of heat exchanging fluid contained therein at all times. The reservoir capacity of heat exchanger 48 can be selected according to the design requirements at hand. Heat exchanging fluid from line 32 is diverted into heat exchanger 48 via line 54 for heat exchange with the engine coolant. Return of diverted heat exchange fluid through line 54 is provided through line 56 by means of a thermostatically controlled threeway valve 58 disposed in line 32. Valve 58 is thermally controlled by the temperature of the heat exchanging fluid in heat exchanger 48. Thermostatically controlled valve 58 is set to open and close at two corresponding predetermined temperatures.

For example, valve 58 will be closed with respect to heat exchanger 48 bypassing exchanger 48 when the temperature of the heat exchanging fluid within heat exchanger 48 has dropped to approximately 25 degrees F. At this point a predetermined quantity of heat exchanging fluid, diverted into heat exchanger 48, will be trapped and begin to heat up due to heat exchange obtained from the engine coolant in the opposing side of heat exchanger 48. A small amount of engine coolant my always be circulated through heat exchanger 48 by a controlled leakage through valve 52 or a restricted bypass line (not shown) around valve 52. When the heat exchanging fluid within heat exchanger 48 reaches approximately 150 degrees F., valve 58 will then open, blocking line 32 and diverting the heat exchanging fluid in heat exchanger 48 back into line 33 to be delivered to heat exchanger 18.

At this point a predetermined quantity of 150-degree heat exchanging fluid will be injected into the downstream line 33 and thence into ambient air heat exchanger 18. Any frost or ice build-up in ambient air heat exchanger 18 will therefore periodically be defrosted to prevent clogging of heat exchanger 18 which typically can occur when warm moist air is cooled when passing through heat exchanger 18.

The 150-degree F. fluid in defrost heat exchanger 48 will, after its standing capacity has been flushed, be replaced by 25-degree F. heat exchanging fluid with the result that valve 58 will again close, taking heat exchanger 48 out of the circuit.

Therefore, according to the invention, heat exchanger 18 is periodically defrosted according to the automatic action of defrost heat exchanger 48. Alternatively or in addition to the automatic thermal cycling, valve 58 may be manually or selectively activated. It is also within the scope of the invention that the controlling temperature, to which valve 58 is responsive, may be chosen at points elsewhere within the circuit of system 10, namely at select points within the heat exchanging fluid loop or within various ones of the heat exchangers, such as ambient air heat exchanger 18.

The result is that the hydraulic subsystem, comprised of pump 34, backpressure device 36, pump 38, heat exchanger 24 and their corresponding lines may be sized at a pressure and flow capacity which allows the hydraulic circuit 13 of vaporizer system 10 to be practically and economically implemented. For example, a nitrogen vaporizing system having a capacity of 450,000 standard cubic feet per hour for nitrogen gas production can be devised utilizing a conventional diesel engine with less than 600 horsepower with the highest pressure within the hydraulic subsystem of not greater than 4000 psi. Again, the backpressure actually chosen can be varied according to the specific design requirements at hand.

Many alterations and modifications may be made by those having ordinary skill in the art without departing from the spirit and scope of the invention. For example, placement of the heat exchangers within system 10 may be organized in various configurations consistent with the principles of the invention. For example, exhaust heat exchanger 48 may instead be placed in a heat exchanging relationship with the water-glycol heat exchanging fluid instead of with the engine coolant. Similarly, hydraulic heat exchanger 24 may be placed in heat exchanging relationship with the engine coolant rather than the heat exchanging fluid. Furthermore, the temperatures illustrated above will change according to the temperature of the ambient, flow rates and other system parameters according to the teaching of the invention. The illustrated embodiment must therefore be understood only as an example set forth for the purposes of clarification and should not be taken as as limitation of the invention as defined in the following claims.

I claim:

1. An apparatus for vaporizing a liquid cryogen comprising:

a heat source;

first means for extracting heat from said heat source;

second means for extracting heat from the ambient environment;

third means for transferring heat from one of said first and second means to said liquid cryogen to partially vaporize said liquid cryogen; and separate fourth means for transferring heat from said heat source to said liquid cryogen to completely vaporize said partially vaporized liquid cryogen, whereby said liquid cryogen is completely vaporized at high flow rate in an economic manner.

2. The apparatus of claim 1 wherein said third means transfers heat only from said first means into said partially vaporized liquid cryogen.

3. The apparatus of claim 1 wherein said third means transfers heat from both said first and second means into said liquid cryogen to partially vaporize said liquid cryogen.

4. The apparatus of claim 3 further comprising fifth means for selectively transferring heat from first means to said second means for extracting heat from said ambient environment to defrost said second means.

5. The apparatus of claim 4 wherein said fifth means is also for selectively removing heat from said first means to regulate the temperature of said heat source.

6. The apparatus of claim 1 further comprising fifth means for selectively transferring heat from first means to said second means for extracting heat from said ambient environment to defrost said second means.

7. The apparatus of claim 6 wherein said fifth means is also for selectively removing heat from first means to regulate the temperature of said heat source.

8. The apparatus of claim 1 wherein said fifth means is also for selectively removing heat from said first means to regulate the temperature of said heat source.

9. The apparatus of claim 1 wherein said heat source is a nonfired heat source.

10. The apparatus of claim 9 wherein said nonfired heat source comprises an internal combustion engine, and said first means comprises:

a hydraulic pump having an output and intake, said hydraulic pump being coupled to and driven by said internal combustion engine;

load means for providing a constant load on said hydraulic pump, said load means coupled to said output of said hydraulic pump;

a hydraulic drive, said hydraulic drive receiving hydraulic fluid from said load means and driven thereby; and a cryogenic pump coupled to and driven by said hydraulic drive, said cryogenic pump for pumping said liquid cryogen through said apparatus.

11. The apparatus of claim 9 wherein said first means comprises:

a liquid cryogenic pump for passing the fluid to be vaporized through said third and fourth means;

loading means for increasing the pumping load on said engine shaft to thereby provide sufficient heat to heat said liquid cryogenic in said third and fourth means, the amount of heat provided being directly proportional to the flow rate of said liquid cryogen provided by said cryogenic pump; and said nonfired heat source comprises a heat engine to provide shaft power and heat output, part of said shaft power being used to drive said liquid cryogenic pump and heat from said heat source being used in said third and fourth means.

12. A method for vaporizing a cryogenic liquid at high flow rates comprising the steps of:

extracting heat from the ambient environment;

simultaneously extracting heat from a heat source;

transferring heat extracted from said ambient environment and heat source into a liquid cryogen to partially vaporize said liquid cryogen; and subsequently transferring heat into said partially vaporized liquid cryogen to completely vaporize said cryogenic liquid, whereby said cryogenic liquid may be vaporized at said high flow rates in a manner which is economically performed.

13. The method of claim 12 where said step of simultaneously extracting heat from a heat source further comprises the steps of:

utilizing a heat engine to provide shaft power and heat; and providing a constant load on said engine so that said engine operates at a greater power level than necessary to provide said shaft power.

14. The method of claim 13 further comprising the steps of:

pumping said liquid cryogen through a flow path;

utilizing a part of said shaft power of said engine to effect said step of pumping;

wherein said step of providing said constant load on said engine operates the engine at a greater power level than necessary to effect said step of pumping in absence of said constant load in order to provide increased heat from said engine; and where in said step of transferring heat to partially vaporize said liquid cryogen, said heat is transferred from said engine into said liquid cryogen flowing through said flow path to thereby partially vaporize said liquid cryogen, the amount of heat provided being directly proportional to the flow rate of said liquid cryogen.

15. The method of claim 12 where said step of extracting heat from said ambient environment comprises the step of flowing air through a heat exchanger and wherein the method further comprises the steps of selectively transferring heat from said heat source to said ambient air heat exchanger to defrost said heat exchanger.

16. The method of claim 15 wherein said heat source is an internal combustion engine having an engine cooling circuit and wherein said step of selectively transferring heat from said heat source to said ambient air heat exchanger comprises the steps of:

selectively filling a defrost heat exchanger with a heat exchanging fluid;

heating said heat exchange fluid in said defrost heat exchanger to a predetermined temperature, automatically flushing said heat exchanging fluid from said defrost heat exchanger when the temperature of said heat exchanging fluid reaches a predetermined temperature; and flowing said heated heat exchanger fluid flushed from said defrost heat exchanger through said ambient air heat exchanger to defrost said ambient air heat exchanger.

17. An apparatus for vaporizing a cryogenic liquid at high flow rates comprising:

an internal combustion engine for producing heat and shaft power;

a heat exchanging fluid pump having an input and output for pumping heat exchanging fluid, said pump driven by said engine;

an ambient air heat exchanger having an input coupled to said output of said heat exchanging fluid pump;

fan means for flowing air through said ambient air heat exchanger, said air being drawn from the ambient environment to transfer heat from said ambient environment into heat exchanging fluid pumped through said ambient air heat exchanger by said heat exchanging fluid pump;

a hydraulic heat exchanger coupled to said ambient air heat exchanger for receiving said heat exchanging fluid from said ambient air heat exchanger, said hydraulic heat exchanger for transferring heat into said heat exchanging fluid from hydraulic fluid being flowed through said hydraulic heat exchanger;

a first liquid cryogen heat exchanger coupled to said hydraulic heat exchanger for receiving said heat exchanging fluid from said hydraulic heat exchanger, said liquid cryogen heat exchanger for transferring heat from said heat exchanging fluid into said liquid cryogen flowing through said liquid cryogen heat exchanger;

a cryogenic pump for pumping said liquid cryogen through said liquid cryogen heat exchanger, said heat exchanging fluid being returned from said liquid cryogen heat exchanger to said heat exchanging fluid pump;

a small sized hydraulic subsystem comprising:

a hydraulic pump coupled to and driven by said engine, said hydraulic pump having an output and intake;

load means for providing a constant hydraulic load on said hydraulic pump, said load means being coupled with said hydraulic pump through said output of said hydraulic pump;

a hydraulic drive coupled with said load means for receiving hydraulic fluid from said load means, said hydraulic drive for providing shaft power for driving said cryogenic pump, said hydraulic fluid flowing through said hydraulic drive being provided to and flowing through said hydraulic heat exchanger for heat transfer from said hydraulic fluid to said heat exchanging fluid, said hydraulic fluid being returned from said hydraulic heat exchanger to said intake of said hydraulic pump; and engine coolant means for circulating engine coolant through said engine to remove heat from said engine; and a second liquid cryogen heat exchanger coupled with said first liquid cryogen heat exchanger, said second liquid cryogen heat exchanger completely vaporizing said liquid cryogen flowing thereto from said first cryogen heat exchanger, said engine coolant also being provided to said second liquid cryogen heat exchanger and returned to said engine, whereby said apparatus vaporizes said liquid cryogen at high flow rates utilizing said small sized hydraulic subsystem.

18. The apparatus of claim 17 further comprising an exhaust heat exchanger, exhaust being provided from said engine to said exhaust heat exchanger, said engine coolant also being provided to said exhaust heat exchanger so that heat is transferred from said exhaust into said engine coolant, said heated engine coolant then being provided to said second liquid cryogen heat exchanger.

19. The apparatus of claim 17 further comprising a defrost heat exchanger coupled with said second liquid cryogen heat exchanger, said defrost heat exchanger being selectively provided with said engine coolant and being selectively provided with said heat exchanging fluid, said engine coolant and heat exchanging fluid being in heat exchanging relationship within said defrost heat exchanger;

first thermostatically controlled means for selectively providing said engine coolant to said defrost heat exchanger at a first predetermined temperature; and second thermostatically controlled means for selectively providing said heat exchanging fluid to said defrost heat exchanger at a second predetermined temperature.

20. The apparatus of claim 19 wherein said first thermostatically controlled means selectively provides engine coolant to said defrost heat exchanger when said engine coolant rises above a predetermined temperature, and wherein said second thermostatically controlled means provides heat exchanging fluid to said defrost heat exchanger when said heat exchanging fluid temporarily stored within said defrost heat exchanger exceeds a predetermined temperature.

* * * * *